US006913334B2

(12) United States Patent
Weichelt

(10) Patent No.: US 6,913,334 B2
(45) Date of Patent: Jul. 5, 2005

(54) DEVICE FOR ESTABLISHING A DETENT CONNECTION

(75) Inventor: Rainer Weichelt, Kirchlengern (DE)

(73) Assignee: Paul Hettich GmbH & Co., Kirchlengern (DE)

( * ) Notice: Subject to any disclaimer, the term of this patent is extended or adjusted under 35 U.S.C. 154(b) by 183 days.

(21) Appl. No.: 10/132,397

(22) Filed: Apr. 26, 2002

(65) Prior Publication Data

US 2002/0158557 A1 Oct. 31, 2002

(30) Foreign Application Priority Data

Apr. 27, 2001 (DE) ..... 201 07 278 U

(51) Int. Cl.[7] ..... A47B 88/04
(52) U.S. Cl. ..... 312/334.4; 312/330.1
(58) Field of Search ..... 312/334.4, 330.1, 312/334.1, 334.5, 334.7, 334.8, 333, 334.13, 334.14, 334.27, 334.31

(56) References Cited

U.S. PATENT DOCUMENTS 4,810,045 A 3/1989 Lautenschlager
5,439,283 A * 8/1995 Schroder et al. ..... 312/334.4
5,580,139 A * 12/1996 Grabher ..... 312/333
5,588,729 A * 12/1996 Berger ..... 312/334.4
5,664,855 A * 9/1997 Lautenschlager et al. ..... 312/334.4

FOREIGN PATENT DOCUMENTS

DE 2639686 * 3/1978 ..... 312/334.4
DE 82 28 143 U 1/1983
DE 4114708 * 11/1992
DE 9300260 * 4/1993
DE 9304521 * 7/1993
EP 761 132 A 3/1997

* cited by examiner

*Primary Examiner*—James O. Hansen
(74) *Attorney, Agent, or Firm*—Barnes & Thornburg LLP

(57) ABSTRACT

A device for establishing an adjustable connection between a drawer, having a panel and a bottom, and a furniture guide rail. The devices comprises a base part adapted for connection to a drawer and a detent element adapted for connection to a guide rail. The base part and detent element are interconnected so that the tolerance between the drawer and guide rail may be adjusted along a displacement axis and then maintained in the adjusted position. A manually operable element is provided for adjustably moving the base part and detent element with respect to each other.

16 Claims, 13 Drawing Sheets

DEVICE FOR ESTABLISHING A DETENT CONNECTION

BACKGROUND AND SUMMARY OF THE INVENTION

The present invention relates to a device for establishing an adjustable connection between a drawer and a guide rail of a piece of furniture.

The device comprises a detent element for connection to a guide rail and a base part for connection to a drawer.

Such devices are fastened on the left and on the right side on a drawer. The drawer will then be connected with the guide rails which are fastened on the left and on the right side on a furniture body.

In the case of the known devices, the distance between the two devices, which are fastened on the drawer, cannot be changed. Since, as a result of the different tolerance sizes, the distances between the mutually opposite guide rails of a piece of furniture cannot always be constant, in practice, difficulties may exist with respect to establishing a secure engagement of the detent devices and thus a secure detent connection between the devices, on the one hand, and the guide rails, on the other hand.

It is an object of the present invention to provide a device of the above-mentioned type which in a simple manner permits an adjustment or an adaptation to the tolerance-caused position of a guide rail of a piece of furniture.

According to the invention, this object is achieved in that the device is constructed of several parts and consists of a base part, which can be fixed on the drawer side, and of the detent element which can be displaced with respect to the base part within limits parallel to the drawer panel.

The invention therefore uses the idea of constructing the device according to the principle of a fixed bearing and of a movable bearing; that is, a part of the device is mounted as a fixed bearing on the drawer side and another part of the device is constructed as a movable bearing which is displaceable with respect to the fixed bearing, so that an adaptation to a tolerance-determined position of a guide rail is possible without any problem.

In the attached drawings, embodiments of the invention are illustrated and will be described in detail in the following.

DETAILED DESCRIPTION OF THE DRAWINGS

Figure 1:
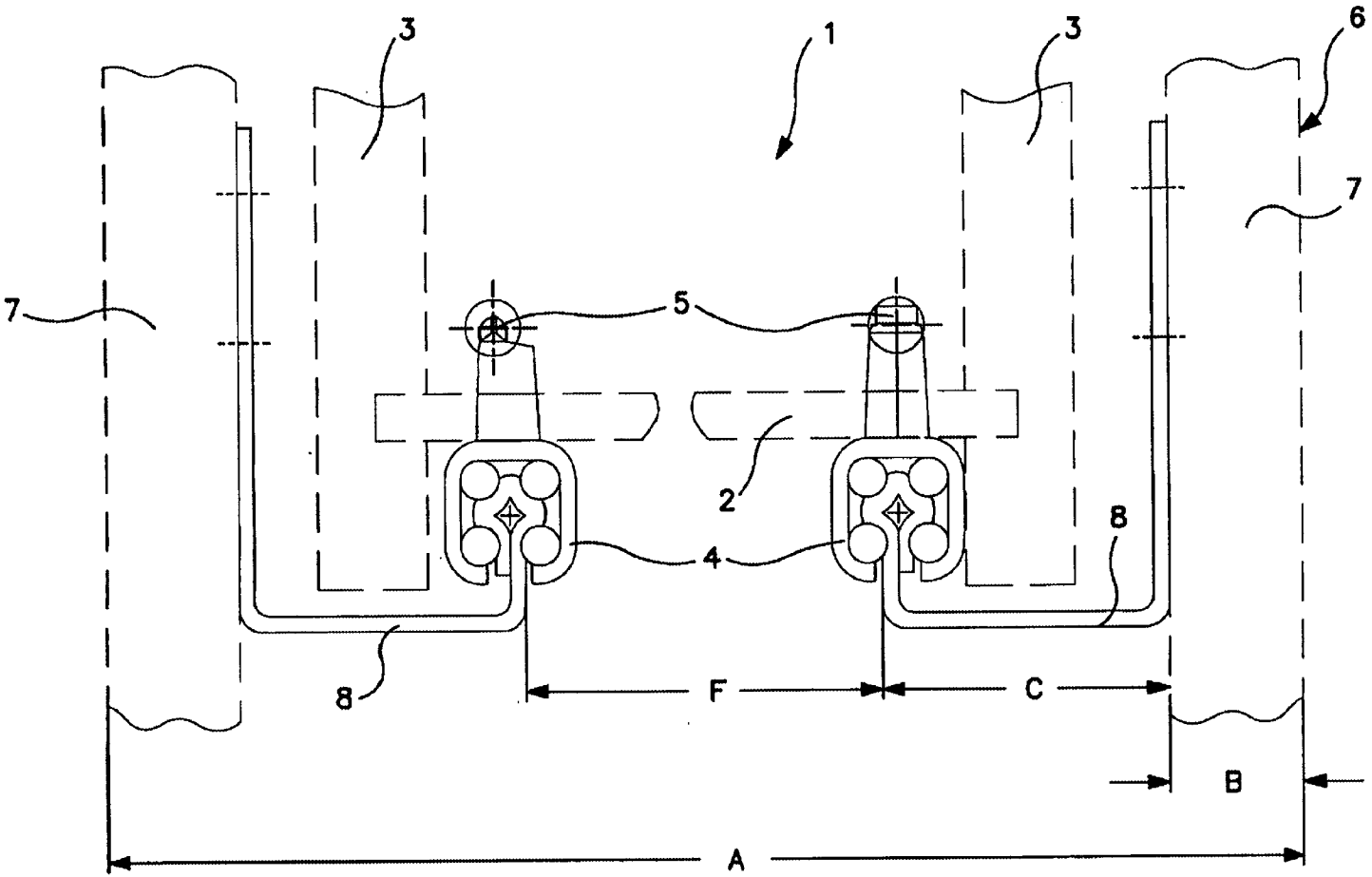
FIG. 1 is a very schematic frontal view of a piece of furniture with a drawer connected by means of guide rails.

FIG. 1 illustrates very schematically that a drawer indicated by the reference number 1, which has a bottom 2 and two side walls 3 as well as a drawer panel not visible in FIG. 1, is carried by two guide rails 4. The drawer 1 must be fixed in the axial direction with respect to the guide rails 4. In a known manner, two hooks 5 in the area of the rear wall of the drawer 1 are used for this purpose which are connected with the guide rails 4, and in the forward area of a drawer panel (not shown here in FIG. 1), devices (not illustrated in FIG. 1 for reasons of clarity) for establishing a detent connection between the drawer 1 and the guide rails 4 are provided.

This basic construction is known per se.

FIG. 1 has the purpose of illustrating that the effective distance of the guide rails 4 from one another may depend on various factors.

In FIG. 1, the effective distance of the guide rails 4 from one another is marked with the letter F. This distance depends on the overall width A of an outlined piece of furniture 6, on the thickness B of the side walls 7 of the piece of furniture 6 as well as on the extent of the bend C of the running rails 8 fastened to the body of the piece of furniture.

Since all above-mentioned components have tolerances, it is easily understandable that the distance F of the two guide rails 4 with respect to one another can definitely also be variable within a furniture series.

It is therefore the purpose of the present invention to provide a device which, as a whole, has the reference number 9 and by means of which a detent connection can be established between a drawer 1 and a guide rail 4 and which, irrespective of the existing tolerances, causes a reliable detent connection between the drawer and the guide rails.

The device 9 according to the invention is equipped in a manner known per se with an elastic detent element 10 which can be manually operated and has a detent recess 11 in which a detent 12 can engage which is provided on the guide rail 4.

The device 9 mounted in a known manner on the underside of a drawer 1 is equipped with a base part 13 which is a component independent of the detent element 10. This base part 13 is used for the fastening on the drawer, for example, on a drawer panel 14 or on the drawer bottom 2.

The detent element 10 is displaceable, specifically parallel to the bottom 2, with respect to the base part 13, which can be called stationary relative to the drawer 1.

Figure 2:
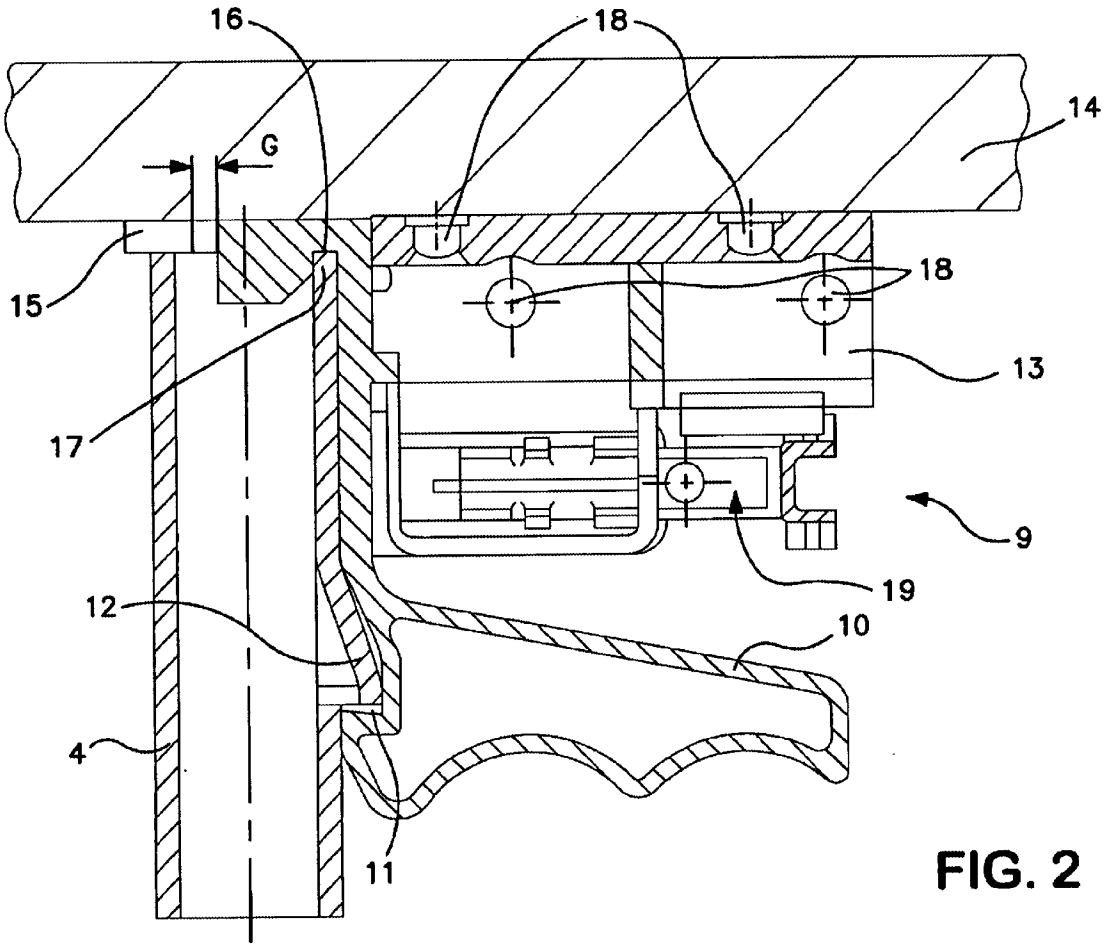
FIG. 2 is a sectional view of the device according to the invention extending parallel to the bottom of a drawer, which device can be fastened to a drawer panel and is coupled with a guide rail of a piece of furniture.
Figure 3:
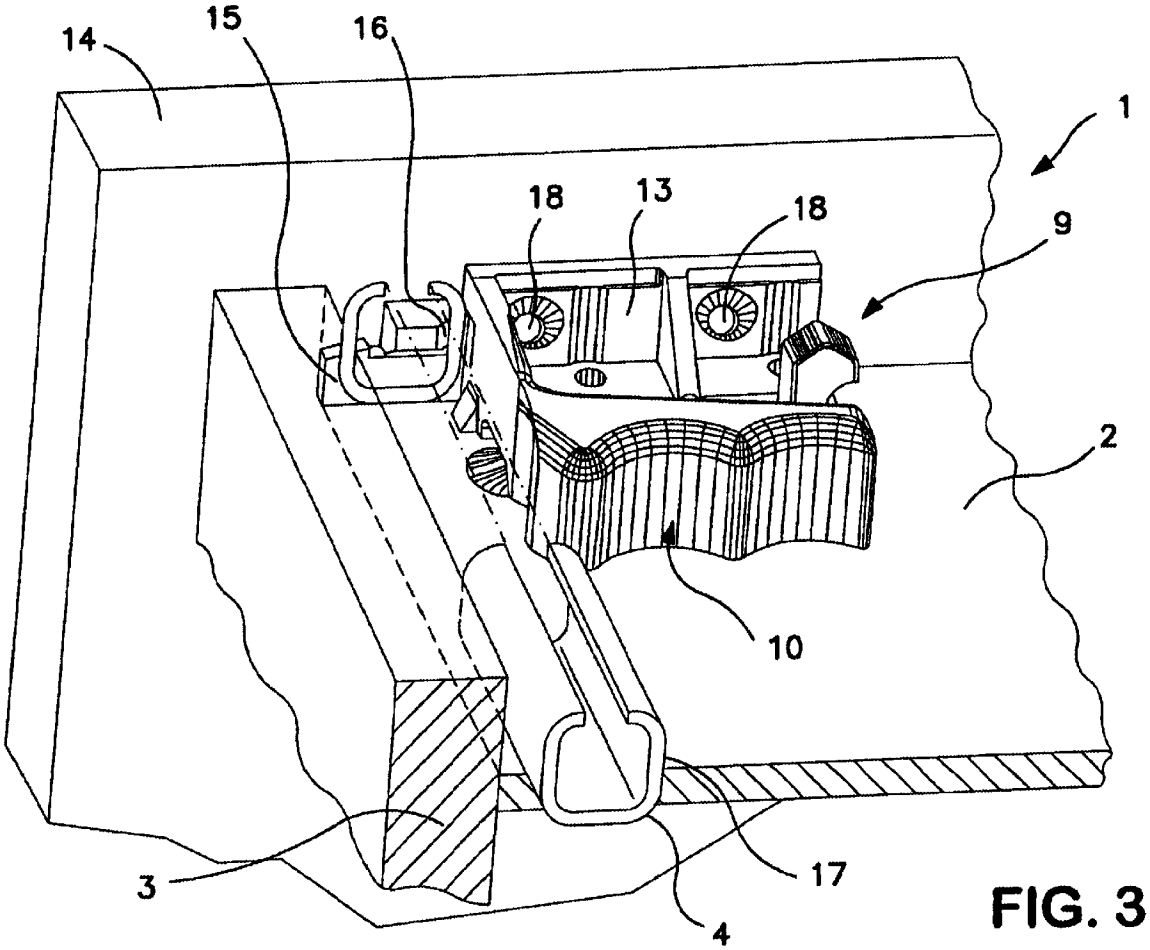
FIG. 3 is a perspective bottom view of a drawer with a device according to the invention.

The extent of the possible displacement is indicated in FIG. 2 by means of the letter G.

As a result of the displaceability of the detent element 10 along displacement axis 37 (FIG. 5) and relative to the stationary base part 13, the difference with respect to the mutual spacing of the guide rails 4, which occurs as a result of tolerances, can be compensated.

The base part 13 and the detent element 10 are captively connected with one another, preferably by means of a stop cam 15 which limits the displacement possibility of the detent element 10 relative to the base part 13.

The detent element 10 is provided with a groove 16 in which a face-side end of a leg 17 of the guide rail 4 engages in the mounted condition. As a result, the detent element 10 is fixed relative to the guide rail 4 in the mounted condition.

For the fastening of the base part 13 on a panel 14 or a bottom 2 of a drawer 1, this base part 13, as illustrated in the drawings, can be provided with passage bores 18 for fastening screws, for fastening rivets, or the like. However, as an alternative, the base part 13 can also be equipped with molded-on dowels 38 (FIG. 5) for forcing into corresponding bores of the drawer.

Figure 8:
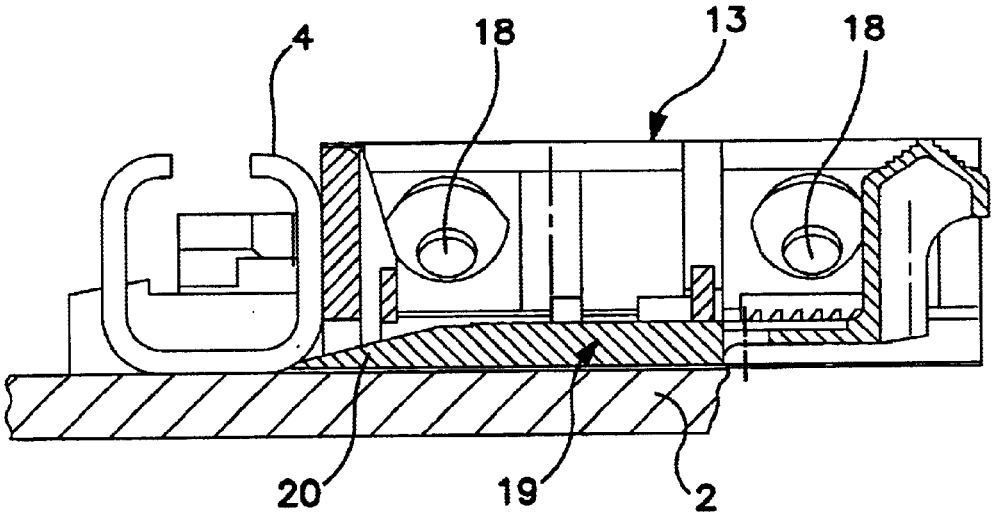
FIG. 8 is a sectional view along Line VIII—VIII in FIG. 6.
Figure 9:
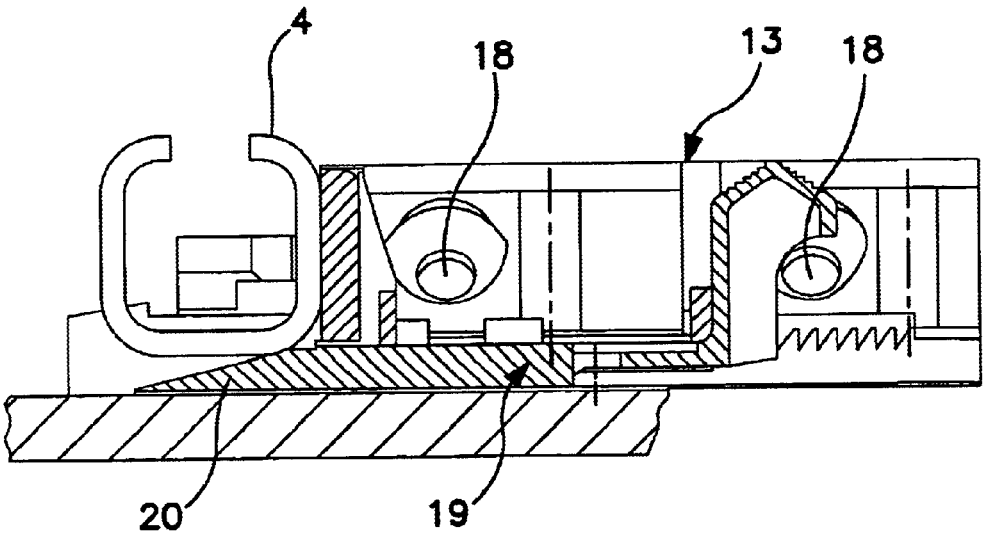
FIG. 9 is a sectional view corresponding to FIG. 8 in height-adjusted situation deviating from FIG. 8.

A wedge 19, which can be displaced parallel to the base part 13 and is secured in every displacement position, is provided on the detent element 10. For the height adjustment of the drawer 1, this wedge 19 can be pushed with a wedge-shaped end 20 between the drawer bottom 2 and the guide rail 4. This is illustrated particularly in FIGS. 8 and 9, FIG. 8 showing a position in which the wedge-shaped end 20 rests directly on the guide rail 4 but has not yet been pushed under this guide rail 4, and FIG. 9 showing the maximal adjusted position.

The wedge 19 permits a simple adjustment of the height of the drawer relative to the guide rails 4.

Figure 4:
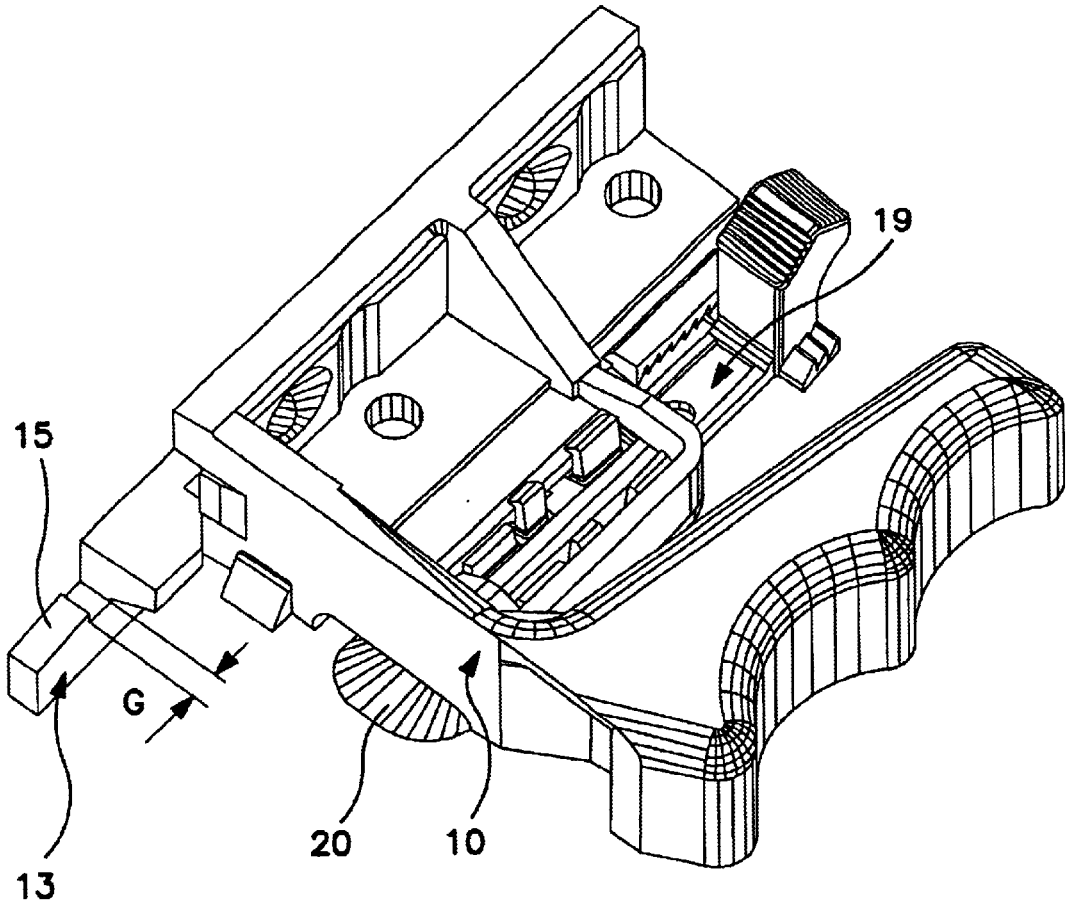
FIG. 4 is a perspective view of the device according to the invention.
Figure 5:
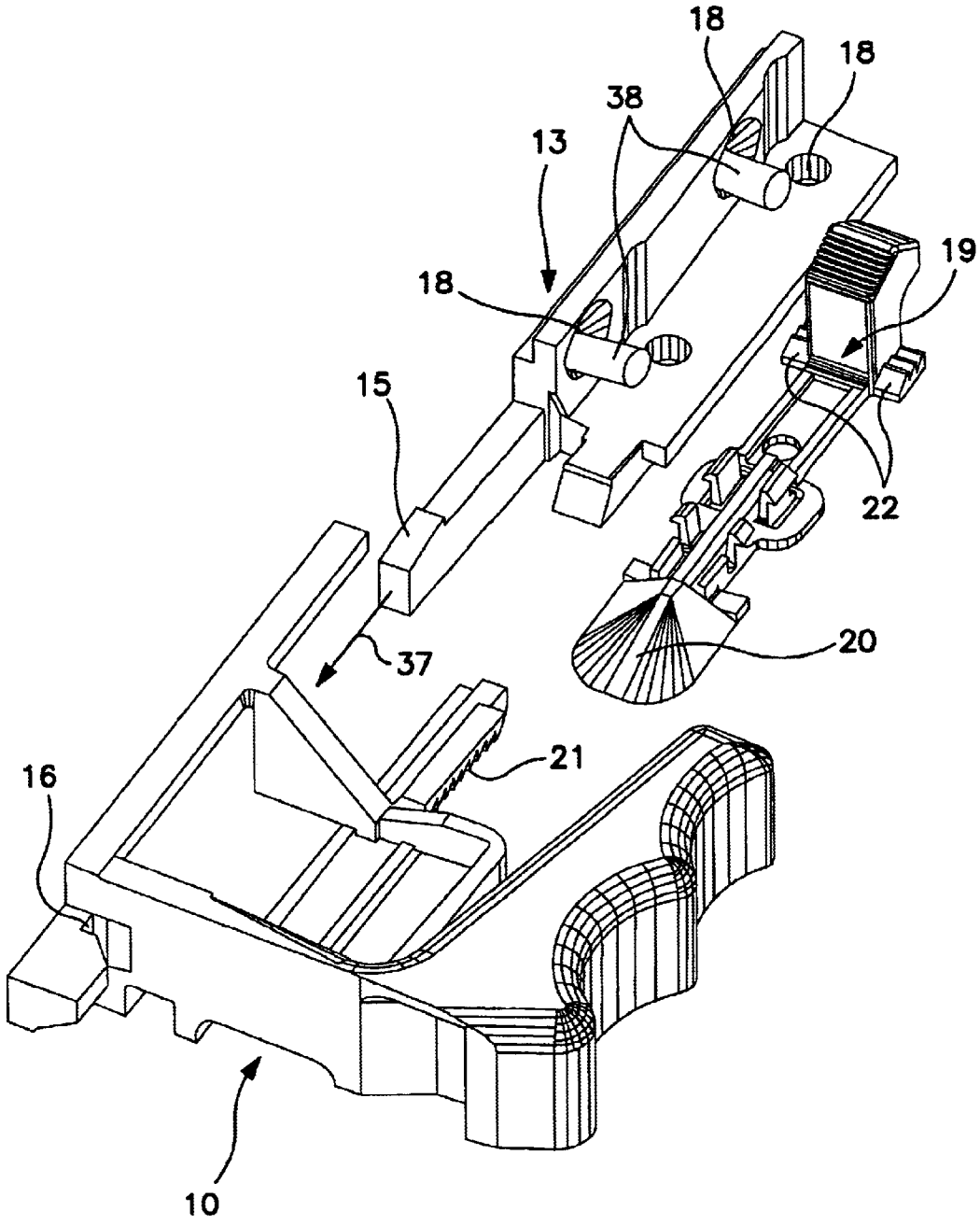
FIG. 5 is a perspective view of the device according to the invention before the assembly of the individual components of the device.

The securing of the wedge 19 with respect to the detent element 10 in any possible displacement position takes place by sawtooth-type notches 21 on the detent element 10, on the one hand, as well as by corresponding sawtooth-type notches 22 on the wedge 19 itself, as illustrated particularly clearly in FIGS. 4 and 5.

Figure 7:
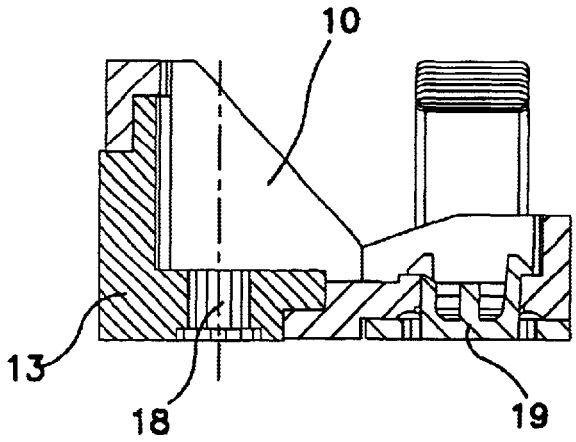
FIG. 7 is a partial sectional view along Line VII—VII in FIG. 6.
Figure 6:
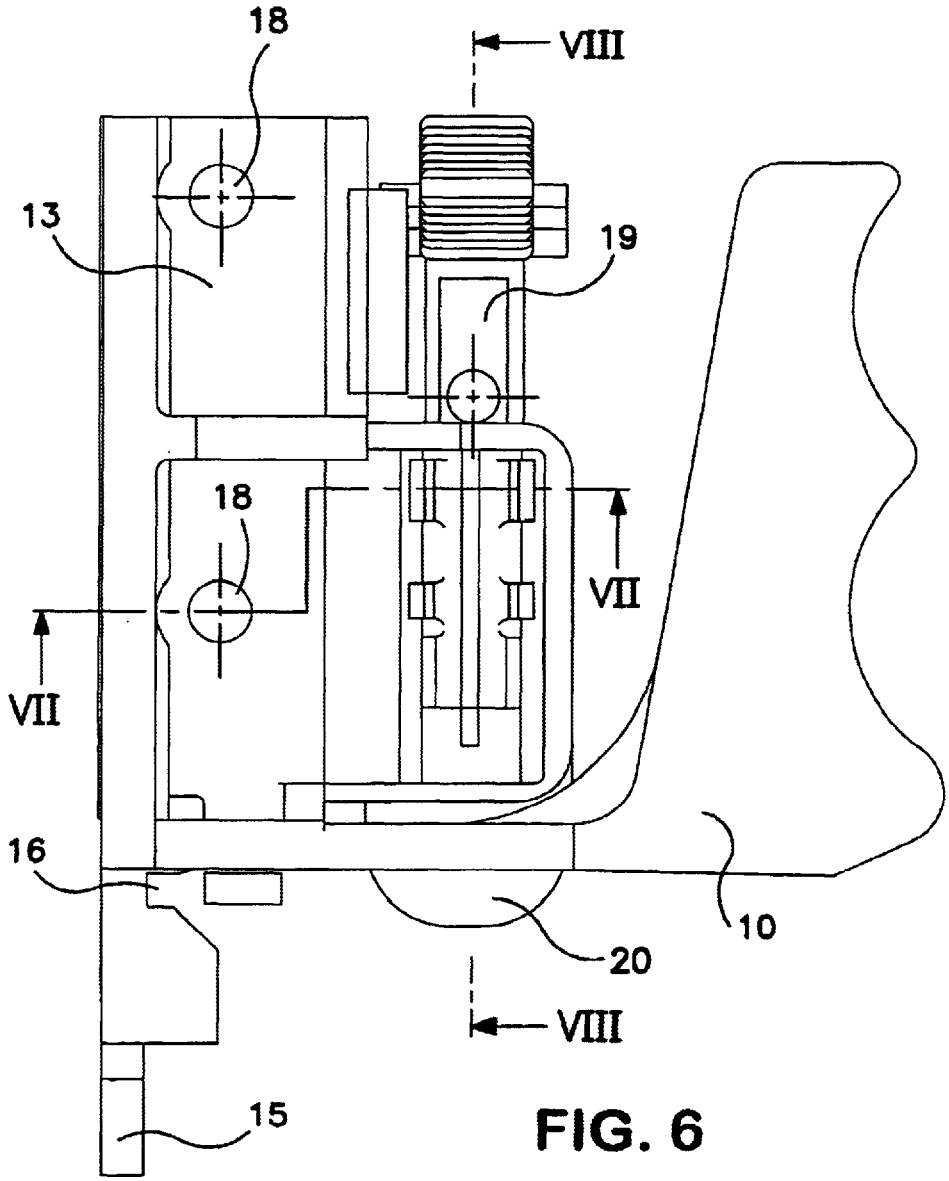
FIG. 6 is a top view of the assembled device according to FIG. 4.

FIGS. 5, 6 and 7 illustrate that the connection between the detent element 10, the base part 13 and the wedge 19 is established by molded-on guiding and detent devices in the form of a clips connection.

Viewed in its displacement direction, the wedge 19 is constructed as a symmetrical component so that it can be used for detent elements 10 usable for the left as well as for the right side.

The base part 13, the detent element 10 and the wedge 19 are preferably made of plastic.

Figure 10:
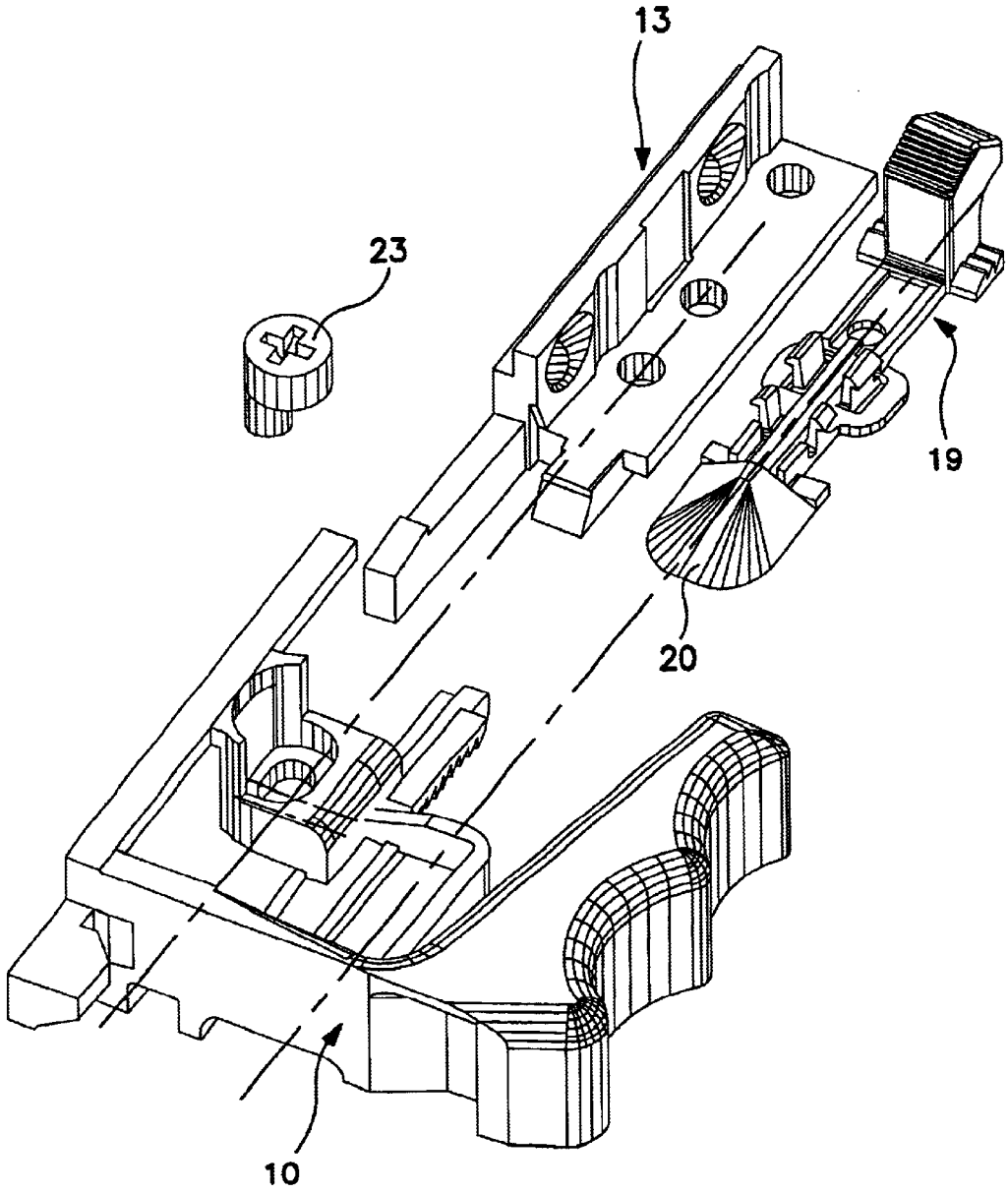
FIG. 10 is a perspective exploded view of a device of the invention according to another embodiment of the invention.
Figure 12:
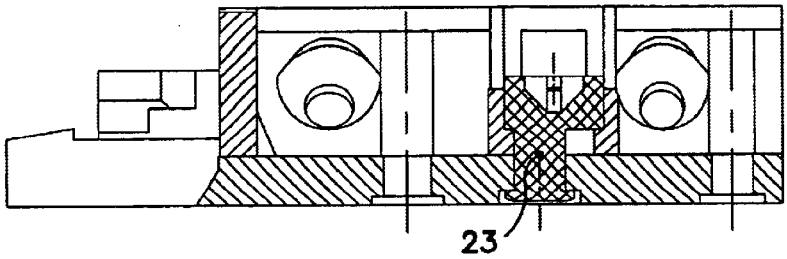
FIG. 12 is a sectional view according to Line XII—XII in FIG. 11.
Figure 11:
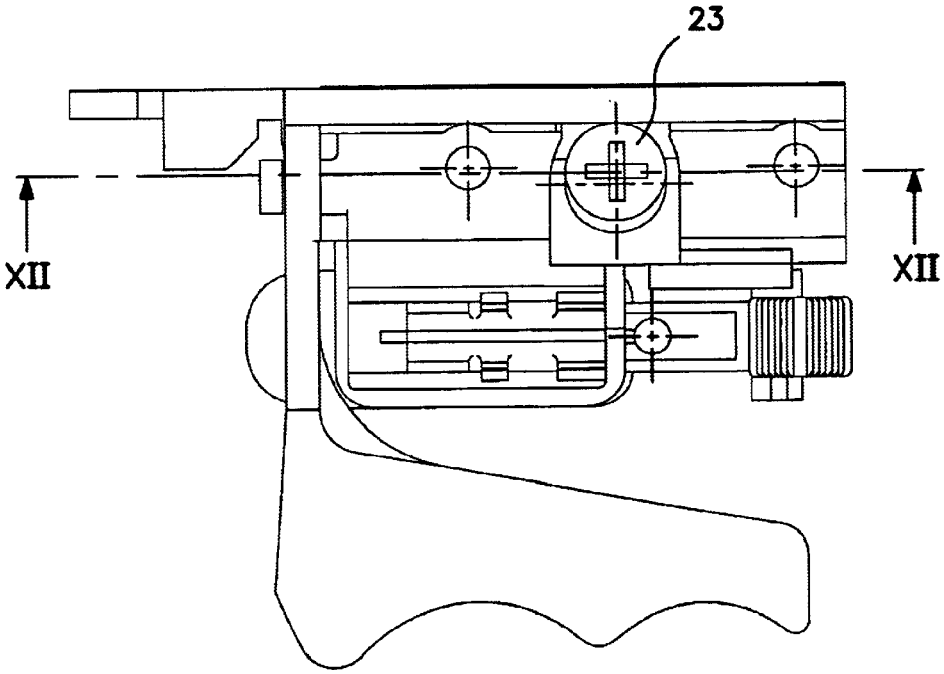
FIG. 11 is a top view of the assembled device according to FIG. 10.

It is illustrated in FIGS. 10 to 12 that the detent element 10 can be adjustable and maintained in the adjusted position with respect to the base part by way of an eccentric 23. By means of this eccentric 23, which, beyond that, secures any taken-up adjusted position between the base part 13 and the detent part 10, a horizontal adjusting of a drawer or its drawer panel can be caused.

In the embodiment according to FIGS. 10 to 12, the eccentric is constructed such that it can be operated by means of tool.

Figure 13:
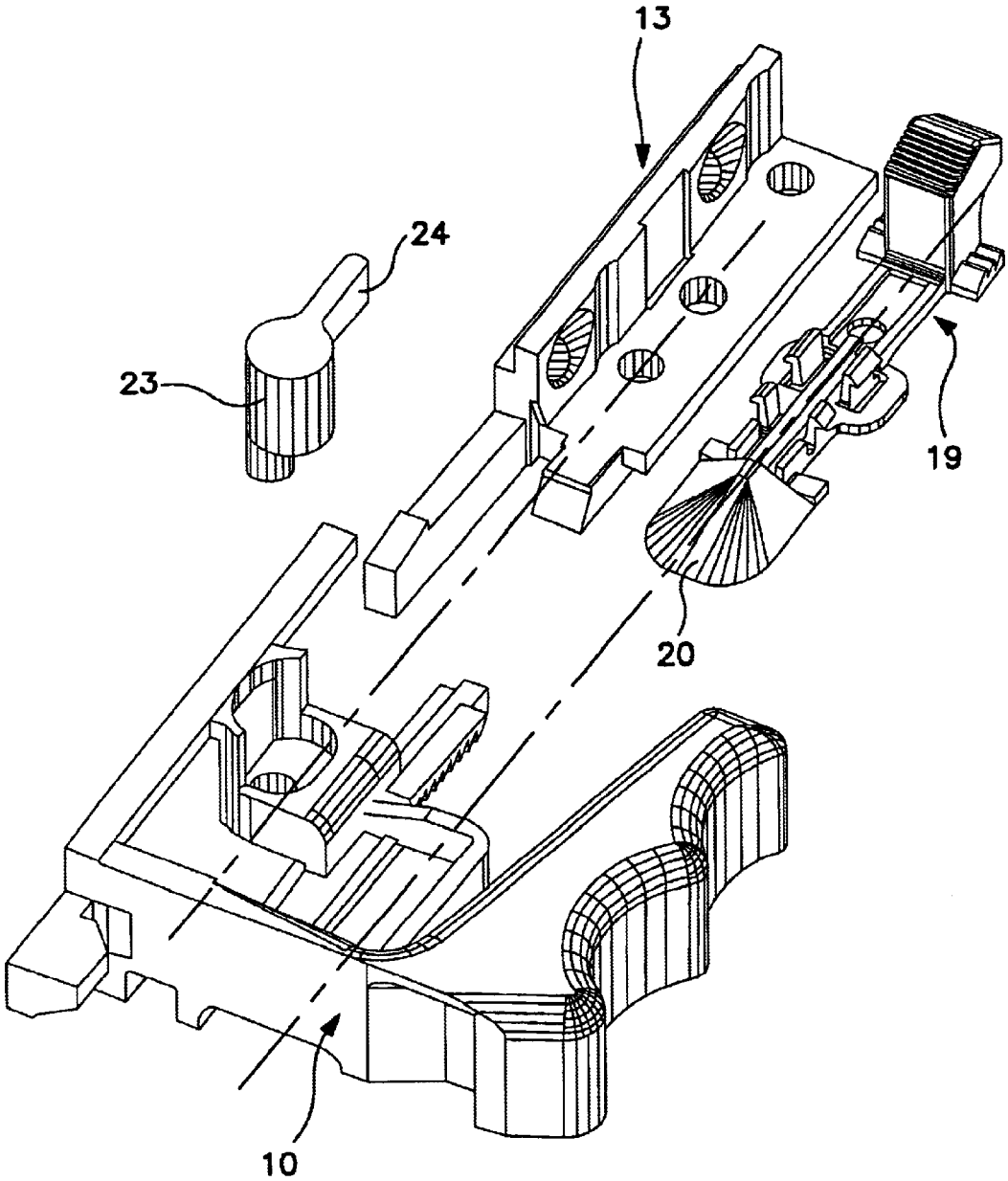
FIG. 13 is a perspective exploded view of a device according to another embodiment of the invention.

FIG. 13 shows that an eccentric 23 can also be equipped with a handle 24 for its adjustment, which handle is molded on in a radially projecting manner.

Figure 14:
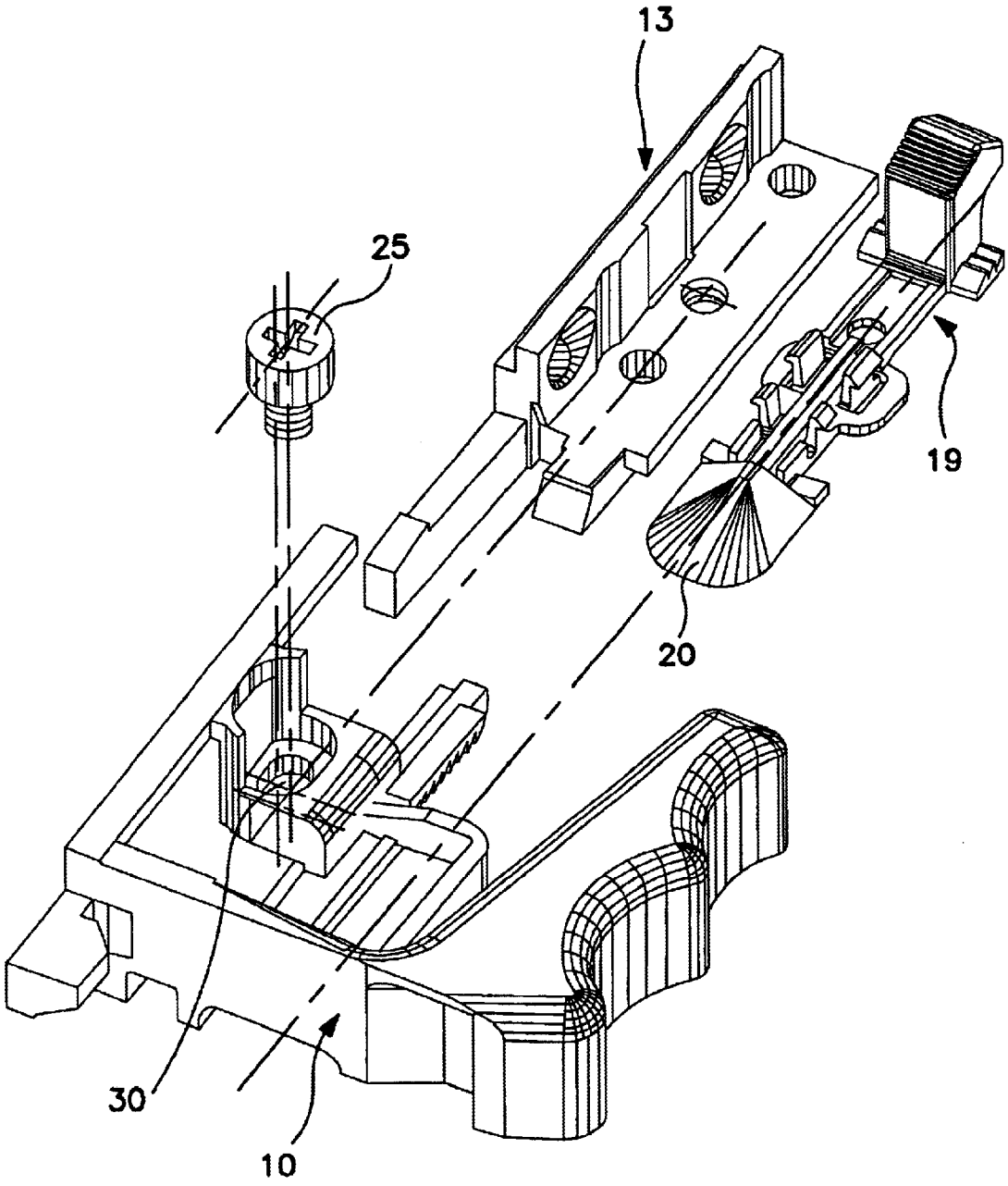
FIG. 14 is an exploded view of a device according to another embodiment of the invention.

FIG. 14 shows a variant of the invention in which any displacement position between the base part 13 and the detent element 10 can be fixed by means of a fixing screw 25 which penetrates the detent element 10 in the area of an oblong hole 30 permitting the displacement.

Figure 15:
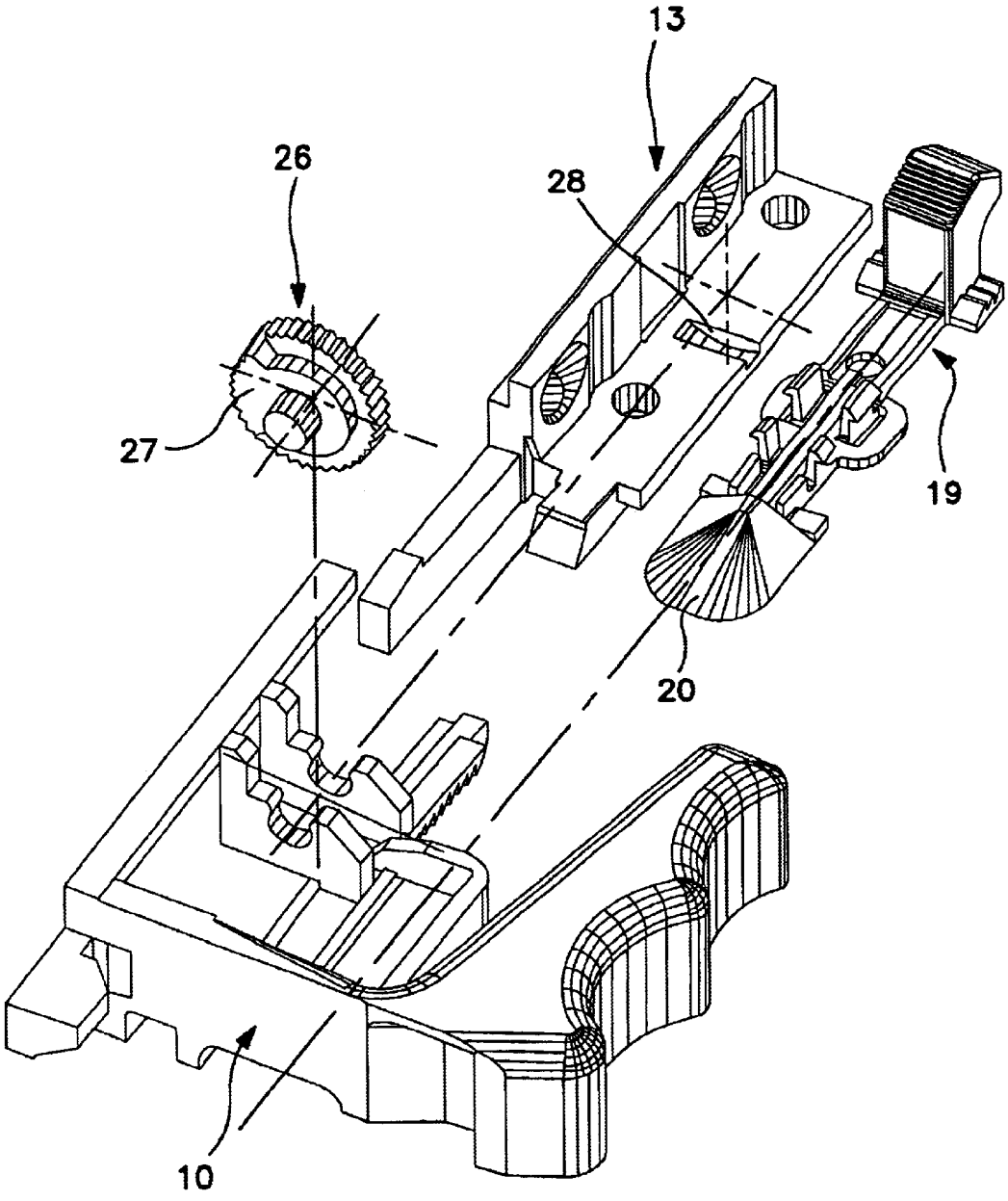
FIG. 15 is an exploded view of another embodiment of the invention.

FIG. 15 finally shows an embodiment in which the adjustment between the base part 13 and the detent element 10 can take place by means of a wheel 26 which is provided with a wedge-type face 27 and is rotatably disposed inside the detent element 10. The wheel 26 may have a knurled surface (as shown in FIG. 15) to aid in manual operation. By means of its disk-type section set off with respect to the wedge-type face, this wheel 26 engages in a groove 28 of the base part 13. When this knurling wheel 26 is now rotated, as a result of the wedge-type cam face 27 of the wheel 26, the detent element 10 is displaced with respect to the base part 13 depending on the rotating direction of the wheel 26.

Figure 16:
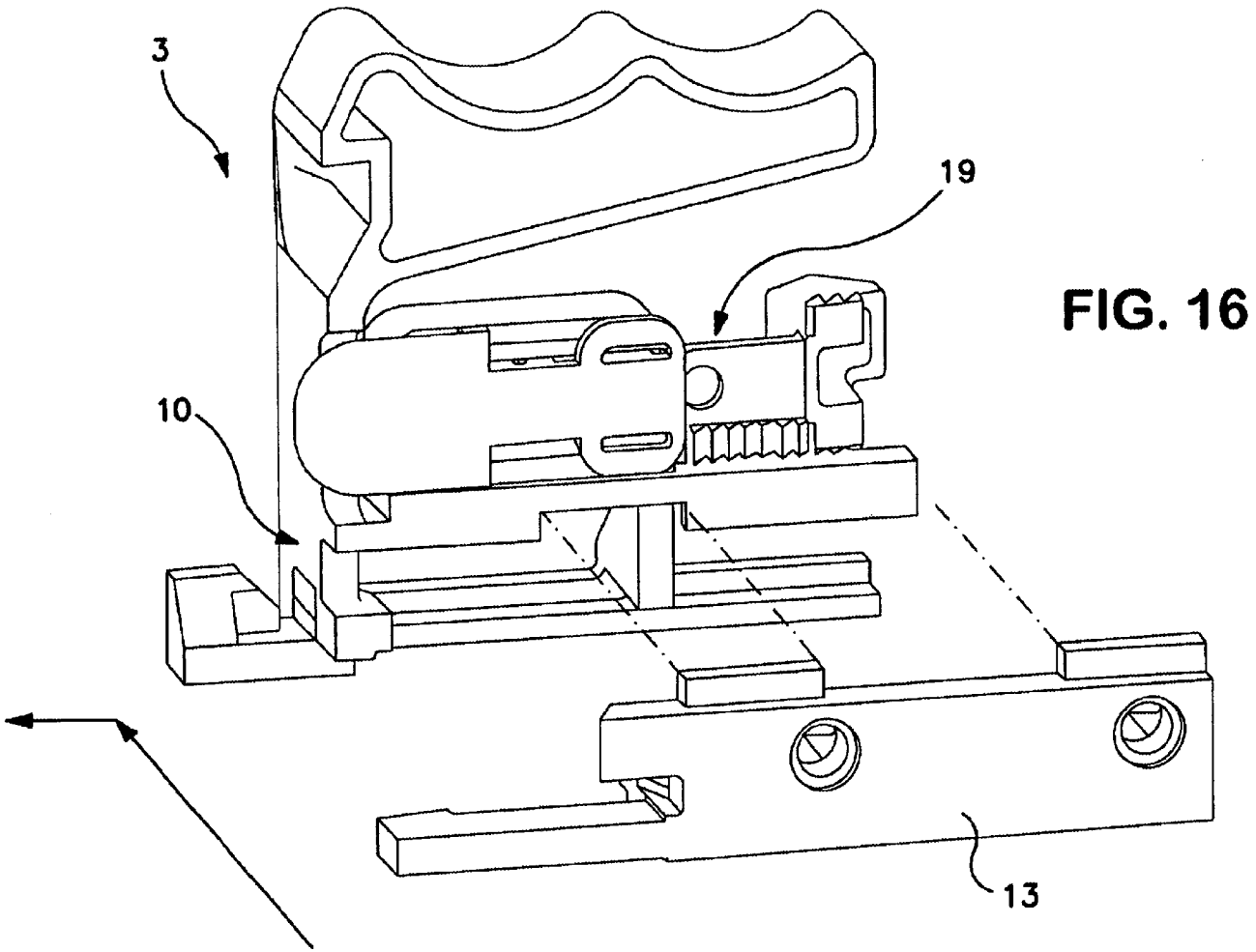
FIG. 16 is a perspective bottom view of a device of the invention according to another embodiment of the invention.

Finally, FIG. 16 shows a bottom view of a device 9 according to the invention, in which the base part 13 and the detent element 10 are designed such that these two parts can be fitted together in another predetermined position and can then be displaced with respect to one another in the displacement direction to the final mounted position in which the parts are held together by a clips connection.

Although the present invention has been described and illustrated in detail, it is to be clearly understood that the same is by was of illustration and example only, and is not to be taken by way of limitation. the spirit and scope of the present invention are to be limited only by the terms of the appended claims.

What is claimed:

1. A device for establishing an adjustable connection between a drawer, having a panel and a bottom, and a furniture guide rail, comprising a base part adapted for connection to a drawer, and a detent element adapted for connection to a guide rail and interconnected to the base part so that the tolerance between the drawer and guide rail may be adjusted along a displacement axis to an adjusted position and then maintained in the adjusted position further comprising a wedge constructed as a component which is symmetrical in the displacement direction and adjustably connected to the detent element for adjusting the height of the drawer by forcing the wedge between the drawer bottom and the guide rail in a displacement direction.

2. A device for establishing an adjustable connection between a drawer, having a panel and a bottom, and a furniture guide rail, comprising a base part adapted for connection to a drawer, a detent element adapted for connection to a guide rail and slidably interconnected to the base part so that the tolerance between the drawer and guide rail may be adjusted along a displacement axis to an adjusted position and then maintained in the adjusted position, and a manually operable element for adjustably moving the base part and detent element with respect to each other.

3. The device according to claim 2, further comprising the base part is provided with passage bores for fasteners such as screws or fastening rivets for fastening the base part to a panel or bottom of a drawer.

4. The device according to claim 2, further comprising fasteners shaped as dowels with a separable molded connection to the base part in positions so that the dowels can be forced into bores in the base part and into the drawer for connecting the drawer and base part.

5. The device according to claim 2, further comprising the detent element is captured and secured on the base part.

6. The device according to claim 2, further comprising adjustment of the base part and the detent element are limited with respect to one another along the displacement axis of the detent element by a stop cam.

7. The device according to claim 2, further comprising the detent element is provided with a groove for receiving a face-side end of a leg of a guide rail.

8. The device according to claim 2, further comprising a wedge which is adjustably connected to the detent element for adjusting the height of the drawer by forcing the wedge between the drawer bottom and the guide rail in a displacement direction.

9. The device according to claim 8, further comprising the wedge is secured with respect to the detent element by sawtooth-type notches.

10. The device according to claim 8, further comprising the base part, the detent element and the wedge are made of plastic.

11. The device according to claim 2, further comprising an eccentric for movably adjusting the detent element with respect to the base part by means of an eccentric.

12. The device according to claim 11, further comprising a radially projecting handle for operating the eccentric is molded to the eccentric.

13. The device according to claim 2, further comprising a fixing screw for securement in an oblong hole in the detent element for fastening the detent element onto the drawer and holding the detent with respect to the base part.

14. The device according to claim 2, further comprising a wheel having a cam face for adjusting the detent element with respect to the base part.

15. The device according to claim 2, further comprising a wheel being mounted on the detent element and fitting into a slot on the base part so that rotation of the wheel forces relative movement of the detent element and base part along the displacement axis.

16. The device according to claim 15, further comprising the wheel has a knurled surface for manual operation of the wheel.

* * * * *